United States Patent [19]

Schroeder

[11] 3,951,068

[45] Apr. 20, 1976

[54] INCENDIARY DEVICE

[75] Inventor: Fred Schroeder, Lakeview Terrace, Calif.

[73] Assignee: Dow Corning Corporation, Midland, Mich.

[22] Filed: July 11, 1974

[21] Appl. No.: 487,475

[52] U.S. Cl. ..... 102/65; 102/68; 102/90; 102/6; 102/66

[51] Int. Cl.[2] ..... F42B 27/04

[58] Field of Search ..... 102/6, 65, 66, 68, 90; 149/19.1, 19.2, 19.3

[56] References Cited

UNITED STATES PATENTS

| | | | |
|---|---|---|---|
| 2,949,352 | 8/1960 | Cramer | 149/19.2 |
| 3,411,964 | 11/1968 | Douda | 149/19.2 |
| 3,669,020 | 6/1972 | Waite et al. | 149/19.3 |

FOREIGN PATENTS OR APPLICATIONS

| | | | |
|---|---|---|---|
| 560,822 | 4/1957 | Italy | 102/66 |

*Primary Examiner*—Verlin R. Pendegrass
*Attorney, Agent, or Firm*—Howard W. Hermann

[57] ABSTRACT

An incendiary device such as artillery round, rocket warhead, bomb, or grenade in which a high explosive charge within a casing has imbedded therein a plurality of balls of incendiary material which is a mixture of silicone rubber, powdered magnesium, and an oxidizing agent. The balls are ignited by detonation of the high explosive and are designed to continue burning during dispersion caused by said detonation.

1 Claim, 2 Drawing Figures

INCENDIARY DEVICE

BACKGROUND OF THE INVENTION

The present invention relates to incendiary devices which are designed to ignite combustible material and are dispersed by means of an explosive charge. Such devices have both military use in the destruction of property and war materiel and civilian application, for example, in starting backfires for forest fire control. Several types of incendiary devices of the general type contemplated by the present invention have been used in the past. One common type has used a flowing, pelleted powder mixture of metal and oxidizer which is dispersed upon detonation of an explosive charge. Such devices, of course, inherently have an obvious hazard insofar as handling is concerned because the materials are spontaneously reactable. Further, they are not totally satisfactory because the pellets tend to disintegrate and burn too rapidly or detonate with the high explosive. The explosive charge tends to disperse the powders in an erratic manner, and over a very short range before burn-out occurs. Thus, neither uniformity nor extent of distribution is often optimum.

Another type of known device makes use of fragments of solid compositions such as zirconium-misch metal, or Thermits. These materials can be cast into a proper form such as the lining of a shell casing which is then filled with the explosive charge. They tend to suffer, however, from handling difficulties due to vacuums and pressures needed for fabrication and to early burn-out and failure to ignite ambient combustible material. Further these materials are brittle and tend to disintegrate upon exposure to the high explosive detonation resulting in a quick burning powder. Misch metal and zirconium also require oxygen for burning and are useless under water or other liquids or at high altitudes where oxygen is scarce.

In my copending U.S. Pat. application Ser. No. 487,474, filed concurrently herewith and entitled "Incendiary Composition" I have disclosed a composition which is made up of magnesium powder and a metal oxide or polytetrafluoroethylene oxidizer in a polysiloxane elastomer matrix. That application is incorporated herein by reference.

SUMMARY OF THE PRESENT INVENTION

It is, therefore, an object of the present invention to provide a new incendiary device which eliminates the shortcomings mentioned above in connection with the prior art. There is provided according to the present invention an incendiary device comprising a casing enclosing a quantity of high explosive charge which has imbedded therein a plurality of substantially spherical bodies of the incendiary material disclosed in the aforesaid copending application. The incendiary material must be one which is capable of being ignited by detonation of the explosive charge and which is further capable of resisting disintegration or detonation and for maintaining sustained burning while being dispersed by said detonation. By experiment it has been found that balls of at least one-half inch diameter which are molded from a composition of ground magnesium, an oxidizer, and a room temperature vulcanizing silicone rubber as a binder as described in my aforesaid copending application are suitable. The use of these spherical objects increases substantially the range over which the incendiary material is effective upon detonation. With the preferred materials heretofore mentioned the silicone rubber serves to isolate the magnesium powder from the oxidizer providing safety in handling and also the composition provides a supply of oxygen to the magnesium so that the system is not dependent upon ambient air for an oxygen source for burning. Further, an ash is formed as the material burns which provides a wicking action for fluids such as diesel oil and thereby assure ignition of such materials.

BRIEF DESCRIPTION OF THE DRAWINGS

Other objects and attendant advantages of the present invention will become known to those skilled in the art from a reading of the following detailed description in connection with the accompanying drawings wherein.

DESCRIPTION OF PREFERRED EMBODIMENTS

Figure 1:
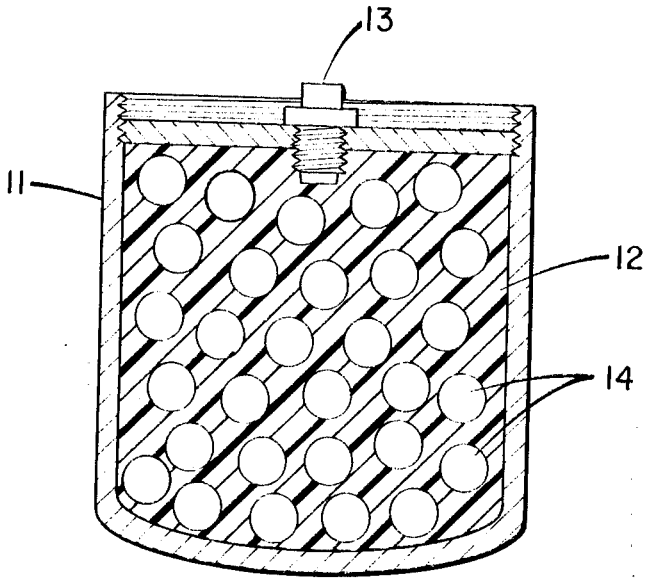
FIG. 1 is a vertical cross-sectional view of a grenade made in accordance with the present invention.
Figure 2:
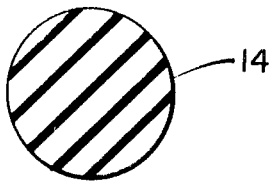
FIG. 2 is a cross-section of one of the incendiary balls incorporated in the grenade in FIG. 1.

Referring now to the drawings wherein like reference characters designate like or corresponding parts throughout the figures thereof there is shown in FIG. 1 a grenade casing 11 which defines an enclosed void filled with high explosive material 12. Detonating means 13 is provided in the casing for detonating the explosive charge. It is to be understood that the shape of the grenade and the type of detonator form no part of the present invention and that the invention is equally applicable to any other type of explosive device such as, for example, an artillery round, rocket warhead, or an air-dropped bomb. The method of delivery of the device to the point of detonation also forms no part of this invention, nor does the specific composition of the high explosive which may, for example, be one of those based on trinitrotoluene although any other suitable high explosive material can also be used.

Imbedded in the high explosive 12 are a plurality of substantially spherical bodies 14 of the incendiary material described in my aforementioned copending application. In a preferred embodiment the incendiary material was made up of a cured mixture of 25% by weight room temperature vulcanizing silicone rubber, 25% magnesium powder of 320 mesh particle size, and 50% by weight $Fe_3O_4$. A suitable silicone rubber RTV is commercially available under the designation of Dow Corning 3,110 RTV encapsulant. The magnesium powder is preferably ground rather than spherical thus providing a greater surface area. Alternatively, other formulations can be used for the spherical body 14. The balls are simply molded from the mixture in the desired size. It has been found from experimentation that a ball smaller than one-half inch in diameter unless propelled by a very small explosive charge is likely to burn up prior to the end of its trajectory after detonation of the high explosive. The maximum size of the ball depends only upon the amount of explosive charge and the desired range.

Upon detonation of the high explosive the explosion causes ignition of the exterior surfaces of the incendiary material as well as dispersion of the spherical bodies. The silicone magnesium composition referred to above provides a relatively slow burning incendiary and a substantial amount of ash is produced which provides a wicking action for materals such as diesel oil to assure easier ignition of such liquids.

Obviously, the principles are applicable to any type of explosive ammunition where an extended range incendiary is desired. Many modifications and variations of the present invention will become obvious to those skilled in the art from a reading of the foregoing. It is to be understood therefore that within the scope of the appended claims the invention can be practiced otherwise than as specifically described.

That which is claimed is:

1. In an incendiary device comprising a casing defining an enclosed void, a high explosive charge filling said void, a plurality of incendiary bodies encapsulated in said high explosive charge, and detonating means in said casing for initiating detonation of the high explosive charge, the improvement which comprises:

said incendiary bodies being spherical molded bodies at least one-half inch in diameter of magnesium and an oxidizer in a silicone rubber binder.

* * * * *